US005229234A

United States Patent [19]

Riddle et al.

[11] Patent Number: 5,229,234

[45] Date of Patent: Jul. 20, 1993

[54] DUAL EXPOSURE METHOD OF FORMING A MATRIX FOR AN ELECTROPHOTOGRAPHICALLY MANUFACTURED SCREEN ASSEMBLY OF A CATHODE-RAY TUBE

[75] Inventors: George H. N. Riddle, Princeton; Louis S. Cosentino, Bell Mead, both of N.J.

[73] Assignee: RCA Thomson Licensing Corp., Princeton, N.J.

[21] Appl. No.: 825,889

[22] Filed: Jan. 27, 1992

[51] Int. Cl.[5] ..... G03C 5/00

[52] U.S. Cl. ..... 430/28; 430/23; 430/29

[58] Field of Search ..... 430/23, 28, 29, 30

[56] References Cited

U.S. PATENT DOCUMENTS

| | | | |
|---|---|---|---|
| 4,448,866 | 5/1984 | Olieslagers et al. | 430/24 |
| 4,921,767 | 5/1990 | Datta et al. | 430/23 |
| 5,028,501 | 7/1991 | Ritt et al. | 430/23 |

OTHER PUBLICATIONS

U.S. patent application Ser. No. 565,828 filed on Aug. 13, 1990 by Datta et al.

*Primary Examiner*—Marion E. McCamish

*Assistant Examiner*—S. Rosasco

*Attorney, Agent, or Firm*—Joseph S. Tripoli; Denis H. Irlbeck; Vincent J. Coughlin, Jr.

[57] ABSTRACT

In an electrophotographic process for manufacturing a luminescent screen assembly on an interior surface of a faceplate panel of a CRT, the panel is first coated with a conductive layer and then overcoated with a photoconductive layer. A substantially uniform charge is established on the photoconductive layer. Selected areas of the photoconductive layer are exposed to actinic radiation, through a shadow mask, to affect the charge on the layer. The unexposed areas of the photoconductive layer are developed with triboelectrically-charged, dry-powdered, light-absorptive screen structure material. The photoconductive layer is reexposed to further discharge those open areas free of the light absorptive material while retaining the charge on those areas having light absorptive matrix material thereon. The reexposure increases the voltage contrast between the exposed and the unexposed areas of the photoconductive layer. A second development of the unexposed areas of the photoconductive layer deposits additional light-absorptive screen structure material on the previously deposited material to increase the opacity of the matrix formed thereby.

4 Claims, 3 Drawing Sheets

34
32
18
12

36
DC VOLTS
34
32
18

38
40
25
34
32
18

18
32
34
42
MATRIX DEVELOPER 44
23a
34
32
18

18
32
34
23a
42'
MATRIX DEVELOPER
DC VOLTS
36

23b
23a
34
32
18

38
46
25
23b
23a
34
32
18

18
23a
32
34
48
23b
PHOSPHOR DEVELOPER

DUAL EXPOSURE METHOD OF FORMING A MATRIX FOR AN ELECTROPHOTOGRAPHICALLY MANUFACTURED SCREEN ASSEMBLY OF A CATHODE-RAY TUBE

The present invention relates to a method of electrophotographically manufacturing a screen assembly for a cathode-ray tube (CRT), and, more particularly, to a method of electrophotographically depositing particles of triboelectrically-charged matrix material, by a dual exposure method, prior to the deposition of the phosphor materials.

BACKGROUND OF THE INVENTION

U.S. Pat. No. 4,921,767, issued to Datta et al. on May 1, 1990, describes a method of electrophotographically manufacturing a luminescent screen assembly for a CRT using triboelectrically-charged matrix and phosphor materials. In the patented method, a photoconductive layer, overlying a conductive layer, is electrostatically charged to a positive voltage and exposed, through a shadow mask, to light from a xenon flash lamp, located in a lighthouse. The exposure is repeated a total of three times, from three different lamp positions, to discharge the areas of the photoconductive layer where the light-emitting phosphors subsequently will be deposited to form the screen. The shadow mask is removed, and triboelectrically-(negatively)charged particles of light-absorptive matrix material are deposited on the positively-charged areas of the photoconductive layer. After the matrix is formed, the photoconductor is recharged to a positive voltage and then exposed to light through the shadow mask, to discharge the areas where the first of three triboelectrically-(positively)charged, light-emitting phosphors will be deposited. Prior to phosphor deposition, the shadow mask, again, is removed from the faceplate panel. Then, the first triboelectrically-(positively)charged phosphor is deposited, by reversal development, on the discharged areas of the photoconductive layer. The process is repeated twice more to deposit the second and third color-emitting phosphor materials.

A drawback of the patented method is the difficulty of obtaining sufficient opacity in the deposited matrix. The opacity is proportional to the amount of light-absorptive material that is deposited in the matrix lines. In the electrophotographic screening process, a high opacity matrix requires a high voltage contrast in the patterned electrostatic image formed on the photoconductive layer. In a 51 cm diagonal tube the matrix lines are only about 0.1 to 0.15 mm (4 to 6 mils) wide and have a pitch, or spacing, between adjacent matrix lines of only about 0.28 mm (11 mils), compared to a width of about 0.27 mm and a pitch of about 0.84 mm (33 mils) for phosphor lines of the same emissive color, thus, the reduced line size and spacing of the matrix lines increase the difficulty of forming images in the lighthouse. The combined effects of the extended width of the flash lamp and the diffraction of the light passing through the slots, or apertures, in the shadow mask, for the three exposures required for the matrix image pattern, produce overlapping penumbras on the photoconductive layer that are not totally black, but which have a light level of about 25% of that found in the highly illuminated areas of the layer. In other words, the exposure through the shadow mask does not produce a light pattern that is either totally illuminated or totally black, but instead produces a pattern of light areas separated by gray penumbras of reduced light intensity. Accordingly, the voltage contrast of the electrostatic image is much lower for the matrix exposure than for the phosphor exposures, and the resultant matrix lines are less opaque than desired, especially at the edges of the lines. It has been determined that because of the above-described light diffraction pattern through the shadow mask, it is not possible to improve the voltage contrast by increasing the exposure time, since the voltage contrast of the photoconductive layer reaches a maximum and then decreases with an increase in light exposure time.

SUMMARY OF THE INVENTION

In an electrophotographic process for manufacturing a luminescent screen assembly on an interior surface of a faceplate panel of a CRT, the panel is first coated with a conductive layer and then overcoated with a photoconductive layer. A substantially uniform charge is established on the photoconductive layer. Selected areas of the photoconductive layer are exposed to actinic radiation, through a shadow mask, to affect the charge on the layer. The unexposed areas of the photoconductive layer are developed with triboelectrically-charged, dry-powdered, light-absorptive screen structure material. The photoconductive layer is reexposed to further discharge those open areas free of the light absorptive material while retaining the charge on those areas having light absorptive matrix material thereon. The reexposure increases the voltage contrast between the exposed and the unexposed areas of the photoconductive layer. A second development of the unexposed areas of the photoconductive layer deposits additional triboelectrically-charged, dry-powdered, light-absorptive screen structure material on the previously deposited light-absorptive screen structure material to increase the opacity of the matrix formed thereby. A multiplicity of red-, green- and blue-emitting phosphor screen elements are then deposited in color groups, in a cyclic order, on the surface of the panel in the areas not occupied by the matrix.

Figure 2:
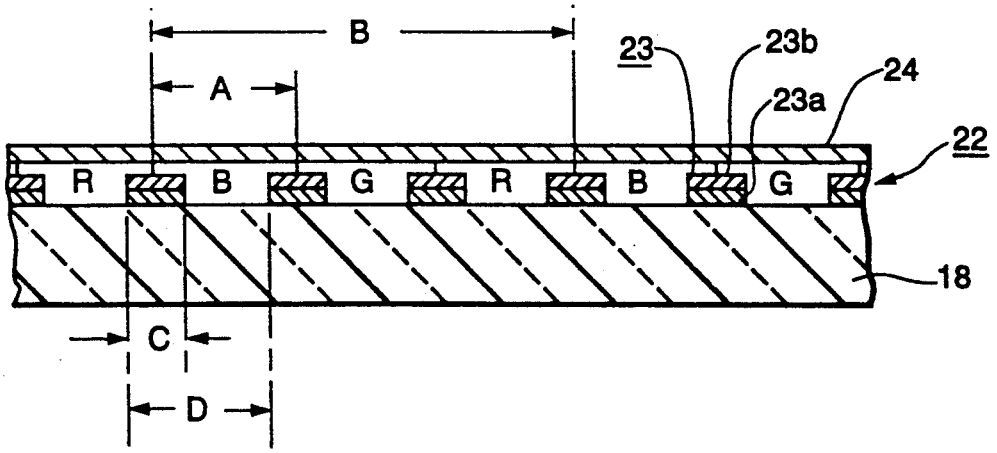
FIG. 2 is a section of a faceplate panel of the CRT of FIG. 1 showing a screen assembly.

FIG. **4*a*–4*i* shows selected steps in the manufacturing of the screen assembly of FIG. 2**.

DETAILED DESCRIPTION OF THE PREFERRED EMBODIMENT

Figure 1:
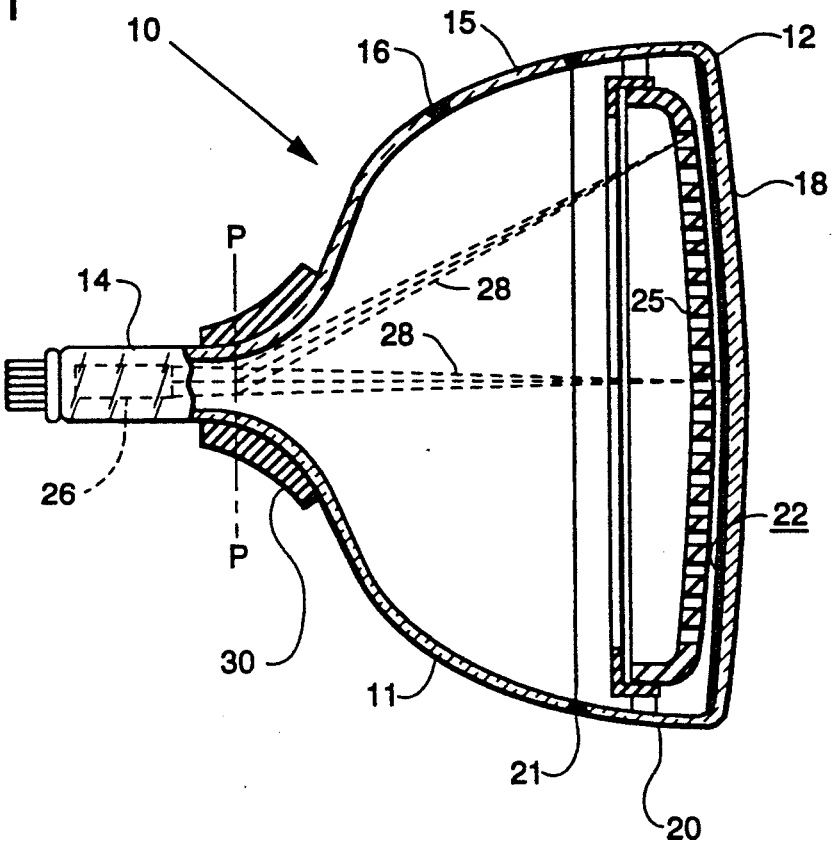
FIG. 1 is a plan view, partially in axial section of a color CRT made according to the present invention.

FIG. 1 shows a color CRT 10 having a glass envelope 11 comprising a rectangular faceplate 12 and a tubular neck 14 connected by a rectangular funnel 15. The funnel 15 has an internal conductive coating (not shown) that contacts an anode button 16 and extends into the neck 14. The panel 12 comprises a viewing faceplate, or substrate, 18 and a peripheral flange, or sidewall, 20 which is sealed to the funnel 15 by a glass frit 21. A three color phosphor screen 22 is carried on the inner surface of the faceplate 18. The screen 22, shown in FIG. 2, preferably is a line screen which includes a multiplicity of screen elements comprised of red-, green- and blue-emitting phosphor stripes, R, G and B, respectively, arranged in color groups, or picture elements, of three stripes, or triads, in a cyclic order, and extending in a direction which is generally normal to the plane in which the electron beams are generated. Typically, for a 51 cm diagonal tube, each of the phosphor stripes has a width, A, of about 0.27 mm and a pitch, B, of about 0.84 mm. In the normal viewing position of the embodiment, the phosphor stripes on the faceplate surface are separated from each other by a light-absorptive matrix material 23 comprising a first matrix layer 23*a* and a second matrix layer 23*b*, overlying the first matrix layer. The matrix lines typically have a width, C, of about 0.10 to 0.15 mm and a pitch, D, of about 0.28 mm. Alternatively the screen can be a dot screen. A thin conductive layer 24, preferably of aluminum, overlies the screen 22 and provides a means for applying a uniform potential to the screen as well as for reflecting light, emitted from the phosphor elements, through the faceplate 18. The screen 22, the matrix 23 and the overlying aluminum layer 24 comprise a screen assembly.

With respect, again, to FIG. 1, a multi-apertured color selection electrode, or shadow mask, 25 is removably mounted, by conventional means, in predetermined spaced relation to the screen assembly. An electron gun 26, shown schematically by the dashed lines in FIG. 1, is centrally mounted within the neck 14, to generate and direct three electron beams 28 along convergent paths, through the apertures, or slots, in the mask 25, to the screen 22.

The tube 10 is designed to be used with an external magnetic deflection yoke, such as yoke 30, located in the region of the funnel-to-neck junction. When activated, the yoke 30 subjects the three beams 28 to magnetic fields which cause the beams to scan horizontally and vertically, in a rectangular raster, over the screen 22. The initial plane of deflection (at zero deflection) is shown by the line P—P in FIG. 1, at about the middle of the yoke 30. For simplicity, the actual curvatures of the deflection beam paths in the deflection zone are not shown.

Figure 3:
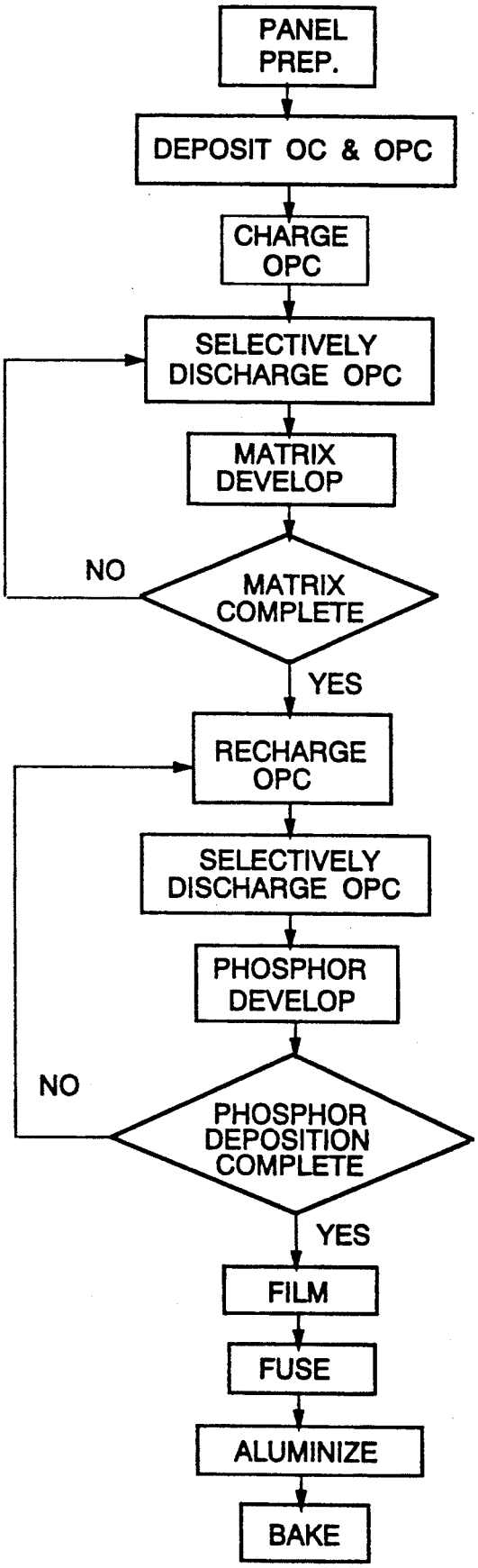
FIG. 3 is a block diagram of the novel manufacturing process for the screen assembly.

The screen 22 is manufactured by an electrophotographic process that is shown in the block diagram of FIG. 3. Selected steps of the process are schematically represented in FIG. 4*a*–4*i*. The present process is similar to the process disclosed in U.S. Pat. No. 4,921,767, issued on May 1, 1990 to Datta et al., and in U.S. Pat. No. 5,028,501, issued on Jul. 2, 1991 to Ritt et al., both of which are incorporated by reference herein for the purpose of disclosure.

Figures 4A, 4B, 4C, 4D, 4E, 4F, 4G, 4H, 4I:
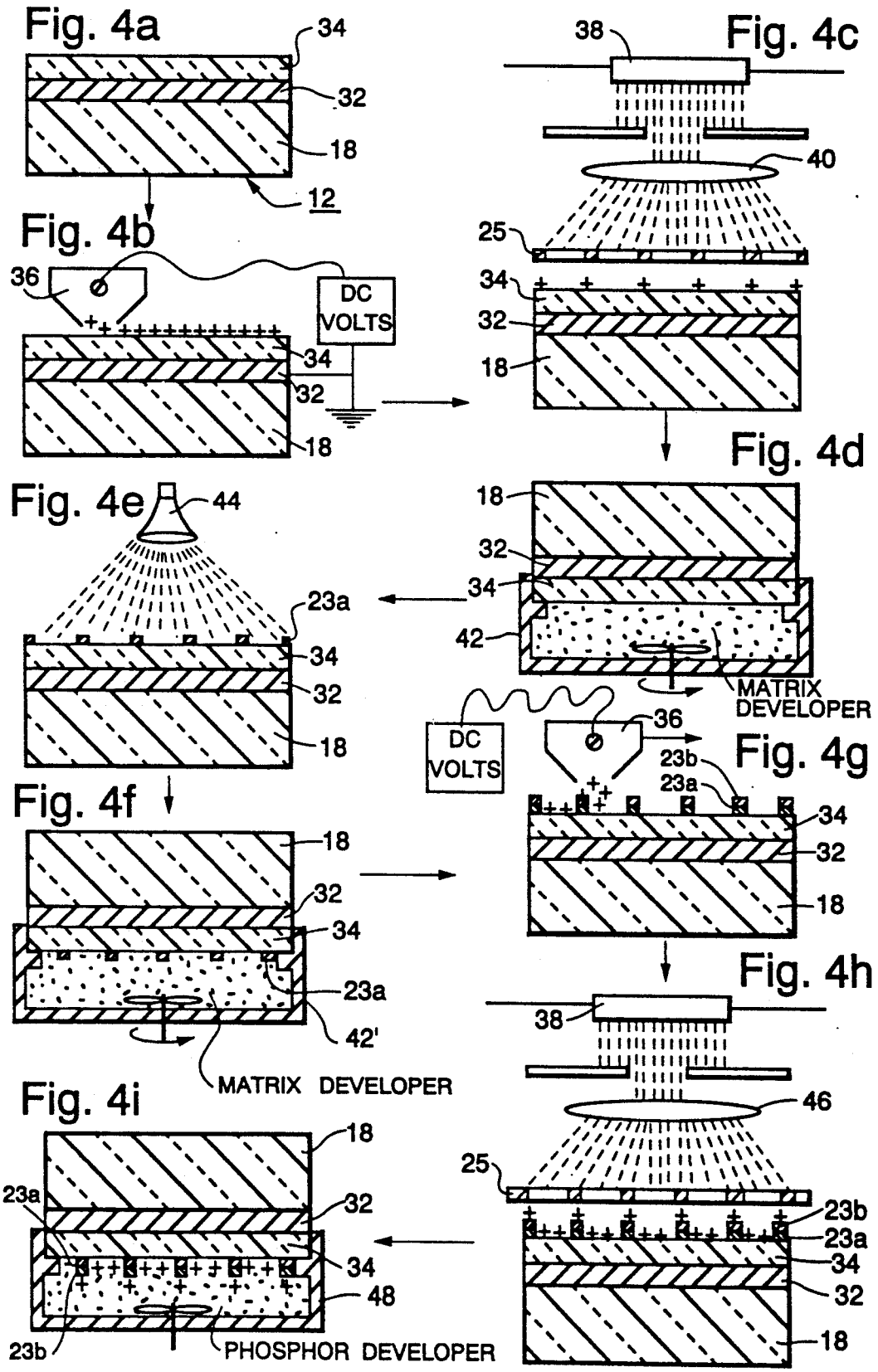

In the present process, the panel 12 initially is washed with a caustic solution, rinsed in water, etched with buffered hydrofluoric acid and rinsed again with water, as is known in the art. As shown in FIGS. 3 and 4*a*, the inner surface of the viewing faceplate 18 is then coated with an electrically conductive organic material which forms an organic conductive (OC) layer 32 that serves as an electrode for an overlying organic photoconductive (OPC) layer 34. Both the OC layer 32 and the OPC layer 34 are volatilizable at a temperature of about 425° C. As shown in FIG. 4*b*, the OPC layer 34 is charged, in a dark environment, to a positive potential of about 200 to 600 volts by a corona discharge apparatus 36, of the type described in copending U.S. patent application Ser. No. 565,828, filed on Aug. 13, 1990, now U.S. Pat. No. 5,083,959, issued on Jan. 28, 1992, which also is incorporated by reference herein for disclosure purposes. The shadow mask 25 is inserted into the panel 12 and the areas of the OPC layer 34, corresponding to the locations where green-, blue-, and red-emitting phosphor material will be deposited, are selectively discharged by being exposed to actinic radiation, such as light from a xenon flash lamp 38, shown in FIG. 4*c*, disposed within a first three-in-one lighthouse (represented by lens 40). The first lamp location within the three-in-one lighthouse approximates the convergence angle of the green phosphor-impinging electron beam, the second lamp location approximates the convergence angle of the blue phosphor-impinging electron beam and the third location, the convergence angle of the red-impinging electron beam. Three exposures are required, from three different lamp positions, to discharge the areas of the OPC layer 34 where the light-emitting phosphors will subsequently be deposited to form the screen. The exposure intensity should be sufficient to establish a useful level of contrast in the electrostatic potential distribution, but not so great as to completely discharge the exposed areas of the OPC layer 34. In particular, sufficient voltage must remain in the exposed areas to permit the establishment of a useful level of contrast in a subsequent second exposure. After the exposure step, the shadow mask 25 is removed from the panel 12 and the panel is moved to a first developer 42, shown in FIG. 4*d*, containing suitably prepared dry-powdered particles of light-absorptive, black matrix screen structure material, and means to triboelectrically-(negatively)charge the finely divided particles. The matrix material generally contains a black pigment, which is stable at tube processing temperatures, a polymer, and a suitable charge control agent. The charge control agent facilitates providing a triboelectrically-negative charge on the matrix particles, as discussed in U.S. Pat. No. 4,921,767. The finely divided particles of triboelectrically-negatively charged matrix material are expelled from the developer 42 and attracted to the positively charged, unexposed areas of the OPC layer 34, in a process known as "direct development", to form the first matrix layer 23*a*. since the unexposed areas of the OPC layer 34 are, nevertheless, partially discharged by the combined penumbra effects of the extensive size of the xenon flash lamp 38 and the diffraction of light passing through the slots in the shadow mask 25, during the matrix exposures, the voltage contrast between exposed and unexposed areas of the OPC layer 34 is limited, and the resultant matrix layer 23*a*, formed by the deposition of the triboelectrically-negatively charged matrix particles, is insufficiently opaque. The opacity is increased in the present novel process by selectively discharging, once again, the OPC layer 34 to further discharge the exposed areas of the OPC layer 34, thereby reestablishing a voltage contrast between the exposed and unexposed areas of the OPC layer, and depositing the second matrix layer 23*b*, on the previously deposited matrix layer 23*a*. In a first embodiment of the present method, the OPC layer 34 and the first matrix layer 23*a* are reexposed to uniform, i.e., flood, illumination, from a lamp 44, shown in FIG. 4*e*, to discharge the open areas of the OPC layer 34. The first matrix layer 23*a* acts as a mask which provides a shadowing effect to prevent the discharge of the underlying portions of the OPC layer, thereby reestablishing the voltage contrast between the exposed and unexposed areas of the OPC layer. The panel 12 next is placed on a second matrix developer 42', shown in FIG. 4*f*, and triboelectrically-negatively charged particles of black matrix material are expelled from the developer and attracted to the positively-charged areas of the OPC layer 34, underlying the previously deposited layer 23*a* of matrix material, to form the second matrix layer 23*b*. The matrix layers 23*a* and 23*b* provide a greater density, i.e., increased opacity of the matrix pattern, than the prior single-step matrix deposition process described in U.S. Pat. No. 4,921,767. The matrix opacity achieved by the novel process cannot be achieved in a single step either by increasing the light intensity incident on the shadow mask, or the exposure time, because the extensive size of the light source and the diffraction of the light through the shadow mask slots creates overlapping penumbras which partially discharge the OPC layer 34 and lower the voltage contrast However, a uniform flood exposure of a panel (without a shadow mask) having a first matrix layer 23*a* thereon does not create penumbras; therefore, a greater voltage contrast is achieved for the second exposure.

Alternatively, the selective discharge of the OPC layer 34, having the first matrix layer 23*a* thereon, may be made by reinserting the shadow mask 25 into the panel 12 and reexposing the open areas of the OPC layer on another three-in-one lighthouse (not shown). This second embodiment of the present method requires the additional steps of reinserting the shadow mask 25 into the panel 12, and repositioning the panel, containing the mask, on the three-in-one lighthouse. In this second embodiment, the resultant voltage contrast in the electrostatic image is improved over prior patented methods, because the first matrix layer 23*a* shields the underlying portion of the OPC layer 34 from the light within the penumbras created by the diffraction of light through the mask apertures; however, the processing according to the second embodiment is more complex than the first embodiment, since it requires the reinsertion of the mask 25 and the repositioning of the panel on the three-in-one lighthouse. The matrix pattern is then fused by heating, if necessary, to form a permanent structure not susceptible to disturbance during the subsequent deposition of the phosphor screen structure materials.

The OPC layer 34, containing the Matrix layers 23*a* and 23*b*, is uniformly recharged, in a dark environment, to a positive potential of about 200 to 600 volts by a corona charger 36, shown in FIG. 4*g*., for the application of the first of the three color-emissive, dry-powdered phosphor screen structure materials. The shadow mask 25 is inserted into the panel 12 and areas of the OPC layer 34, corresponding to the locations where green-emitting phosphor material will be deposited, are selectively discharged by exposure to actinic radiation, such as light from a xenon flash lamp 38, shown in FIG. 4*h*, disposed within a second lighthouse (represented by lens 46). The first lamp location within the second lighthouse 46 approximates the convergence angle of the green phosphor-impinging electron beam. The shadow mask 25 is removed from the panel 12, and the panel is moved to a first phosphor developer 48 containing suitably prepared dry-powdered particles of green-emitting phosphor screen structure material. The dry-powdered phosphor particles previously have been surface treated with a suitable charge controlling material, which encapsulates the phosphor particles and permits the establishment of a triboelectrically positive charge thereon. The positively-charged, green-emitting phosphor particles are expelled from the developer, repelled by the positively-charged areas of the OPC layer 34, and deposited onto the exposed, discharged areas of the OPC layer 34, in a process known as "reversal developing". Surface treating and triboelectric charging of the phosphor particles, and the developing of the OPC layer 34 are described in U.S. Pat. No. 4,921,767.

The processes of charging, selectively discharging, and phosphor developing are repeated for the dry-powdered, blue- and red-emitting phosphor particles of screen structure material. The exposure to actinic radiation, to selectively discharge the positively-charged areas of the OPC layer 34, is made from a second and then from a third position within the lighthouse, to approximate the convergence angles of the blue phosphor- and red phosphor-impinging electron beams, respectively. The blue- and the red-emitting phosphor particles also are surface treated, to permit them to be triboelectrically charged to a positive potential. The blue- and red-emitting phosphor particles are expelled from second and third developers 48, repelled by the positively-charged areas of the previously deposited screen structure materials, and deposited on the discharged areas of the OPC 34, to provide the blue- and red-emitting phosphor elements, respectively.

The screen structure materials, comprising the black matrix material and the green-, blue- and red-emitting phosphor particles are electrostatically attached, or bonded, to the OPC layer 34. As described in U.S. Pat. No. 5,028,501, the adherence of the screen structure materials can be increased by directly depositing thereon an electrostatically-charged, dry-powdered, filming resin from a sixth developer (not shown). The OC layer 32 is grounded during the deposition of the filming resin. A substantially uniform potential of about 200 to 400 volts is applied to the OPC layer 34 using a discharge apparatus 36, similar to that shown in FIGS. 4*b* and 4*g*, prior to the filming step, to provide an attractive potential and to assure a uniform deposition of the resin which, in this instance, is charged negatively. The developer may be, for example, an electrostatic gun, for example as manufactured by Ransburg-GEMA, which charges the resin particles by corona discharge. The resin is an organic material with a low glass transition temperature/melt flow index of less than about 120° C., and with a pyrolization temperature of less than about 400° C. The resin is water insoluble, preferably has an irregular particle shape for better charge distribution, and has a particle size of less than about 50 microns. The preferred material is n-butyl methacrylate; however, other acrylic resins, methyl methacrylates and polyethylene waxes have been used successfully. About 2 grams of powdered filming resin is deposited onto the screen surface 22 of the faceplate 18. The faceplate is then heated to a temperature of between 100° to 120° C., for about 1 to 5 minutes using a suitable heat source, such as radiant heaters, to fuse the resin into the film (not shown). The resultant film is water insoluble and acts as a protective barrier, if a subsequent wet-filming step is required to provide additional film thickness or uniformity. An aqueous 2 to 4%, by weight, solution of boric acid or ammonium oxalate is oversprayed onto the film to form a ventilation-promoting coating (not shown). Then, the panel 12 is aluminized, as is known in the art, to form the aluminum layer 24, and baked at a temperature of about 425° C., for about 30 to 60 minutes, or until the volatilizable organic constituents of the screen assembly are removed.

What is claimed is:

1. In a method of electrophotographically manufacturing a luminescent screen assembly on an interior surface of a faceplate panel of a CRT, said panel having a conductive layer overcoated with a photoconductive layer and having a multiplicity of red-emitting, green-emitting and blue-emitting phosphor screen elements separated from each other by a light-absorptive matrix, said phosphor screen elements being arranged in color groups, in a cyclic order, said phosphor screen elements being formed by sequentially exposing selected areas of said photoconductive layer to actinic radiation to affect the charge thereon and, then, applying triboelectrically charged red-, green- and blue-emitting phosphors, respectively, to said areas, the improvement wherein said matrix is formed by initially establishing a substantially uniform charge on said photoconductive layer, exposing selected areas of said photoconductive layer to actinic radiation, through a mask, to affect the charge thereon, developing the unexposed areas of said photoconductive layer with triboelectrically charged, dry-powdered, light-absorptive screen structure material, reexposing said photoconductive layer to further discharge those open areas free of said light-absorptive matrix material while retaining said charge on those areas having light-absorptive matrix material thereon, thereby increasing the voltage contrast between the exposed and unexposed areas of said photoconductor, making a second development of the unexposed areas by depositing said triboelectrically-charged, light-absorptive matrix material on said previously deposited matrix material to increase the opacity of the matrix created thereby.

2. The method as in claim 1, further including the steps of sequentially exposing selected areas of said photoconductive layer to actinic radiation to affect the charge thereon and then applying triboelectrically-charged red-, green- and blue-emitting phosphor materials, respectively, to said areas to form phosphor screen elements, forming a film on said phosphor screen elements and said matrix material, aluminizing said film, and baking said faceplate panel to remove the volatilizable constituents to form said luminescent screen assembly.

3. The method as in claim 1, wherein said reexposing of said photoconductive layer includes flood illumination.

4. The method as in claim 1, wherein said reexposing of said photoconductive layer includes exposing, through a mask, the previously exposed areas of said photoconductive layer to light from a xenon lamp to affect the charge thereon without substantially affecting the areas of the photoconductive layer underlying the previously deposited matrix material.

* * * * *